United States Patent [19]

Takeuchi et al.

[11] Patent Number: 4,572,136

[45] Date of Patent: Feb. 25, 1986

[54] FUEL INJECTION APPARATUS FOR AN INTERNAL COMBUSTION ENGINE

[75] Inventors: Yasuhiro Takeuchi, Okazaki; Yasuyuki Sakakibara, Nishio; Kazuhide Watanabe, Toyohashi, all of Japan

[73] Assignee: Nippon Soken, Inc., Nishio, Japan

[21] Appl. No.: 650,719

[22] Filed: Sep. 14, 1984

[30] Foreign Application Priority Data

Sep. 19, 1983 [JP] Japan ..... 58-171282

[51] Int. Cl.[4] ..... F02M 39/00

[52] U.S. Cl. ..... 123/447; 123/457

[58] Field of Search ..... 123/447, 446, 457, 510, 123/511

[56] References Cited

U.S. PATENT DOCUMENTS

| | | | |
|---|---|---|---|
| 2,986,881 | 6/1961 | Moore | 123/447 |
| 3,557,764 | 1/1971 | Knight | 123/447 |
| 3,827,409 | 8/1974 | O'Neill | 123/447 |
| 4,275,693 | 6/1981 | Leckie | 123/447 |
| 4,409,939 | 10/1983 | Eheim et al. | 123/447 |
| 4,469,069 | 9/1984 | Kuroyanagi et al. | 123/447 |

FOREIGN PATENT DOCUMENTS

| | | | |
|---|---|---|---|
| 2113318 | 8/1983 | United Kingdom | 123/446 |

*Primary Examiner*—Magdalen Y. C. Moy

*Attorney, Agent, or Firm*—Cushman, Darby & Cushman

[57] ABSTRACT

A fuel injection apparatus for an internal combustion engine, which comprises an accumulator for storing therein pressurized fuel while maintaining the pressure thereof at a predetermined high level. A fuel injection valve is arranged to inject the pressurized fuel in the accumulator into a combustion chamber of the engine. The injection valve is controlled to open and close by an output signal from an external control unit. A pressurizing pump is arranged to pressurize the fuel delivered from a fuel-feed pump and to supply it into the accumulator through a check valve. A work controlling device is arranged to control the amount of the fuel supplied from the pressurizing pump through the check valve into the accumulator in accordance with the variation of the amount of the fuel in the accumulator so as to decrease the amount of the fuel supplied from the pressurizing pump through the check valve into the accumulator when the amount of the fuel in the accumulator is increased and to increase it when the amount of the fuel in the accumulator is decreased.

12 Claims, 5 Drawing Figures

FUEL INJECTION APPARATUS FOR AN INTERNAL COMBUSTION ENGINE

BACKGROUND OF THE INVENTION (1) Field of the Invention

The present invention relates to a fuel injection apparatus for an internal combustion engine, more particularly to an improved fuel injection apparatus which includes an accumulator for storing the pressurized fuel while maintaining the pressure thereof at a predetermined high level; a fuel injection valve for injecting the pressurized fuel in the accumulator into a combustion chamber of the engine, and a pressurizing pump for pressurizing the fuel delivered from a fuel-feed pump and for supplying it into the accumulator through a check valve.

(2) Description of the Prior Art

In a conventional fuel injection apparatus for an internal combustion engine, a constant amount of fuel is kept pressurized by a pressurizing pump and delivered through a check valve into an accumulator. An external control unit outputs a signal to an injection valve to open and close it and thus control the injection amount and timing of the pressurized fuel.

When the accumulator is refilled with enough pressurized fuel to compensate for the consumption of the fuel by the injection valve, it has been necessary in prior art apparatuses to return any excessive fuel discharged from the pressurizing pump to a low pressure side, e.g., a fuel tank, through a relief valve. This means that the pressurizing pump in the prior art apparatus is always doing extra work. Such extra work not only means the pressurizing pump wastes energy, but also results in an unfavorable temperature rise of the fuel, increase of noise or vibration, and fluctuation of the fuel pressure.

SUMMARY OF THE INVENTION

Accordingly, the present invention has an object to provide a fuel injection apparatus which eliminates the drawbacks of the prior art apparatus.

According to the present invention, there is provided a fuel injection apparatus for an internal combustion engine including an accumulator for storing therein pressurized fuel while maintaining the pressure thereof at a predetermined high level; a fuel injection valve for injecting the pressurized fuel in the accumulator into a combustion chamber of the engine, the injection valve being controlled to open and close by an output signal from an external control unit; a pressurizing pump for pressurizing the fuel delivered from a fuel-feed pump and for supplying it into the accumulator through a check valve; and a work controlling means for controlling the amount of the fuel supplied from the pressurizing pump through the check valve into the accumulator in accordance with the variations in the amount of the fuel in the accumulator so as to decrease the amount of the fuel supplied from the pressurizing pump through the check valve into the accumulator when the amount of the fuel in the accumulator is increased and to increase it when the amount of the fuel in the accumulator is decreased.

According to the present invention, there is also provided a fuel injection apparatus for an internal combustion engine, including a fuel-feed pump for continuously discharging through an outlet side thereof fuel under pressure of a predetermined first level which is higher than atmospheric pressure, the fuel-feed pump being connected at an inlet side thereof to a fuel tank which stores the fuel under atmospheric pressure; an accumulator including an accumulation housing having therein a cylindrical bore, a piston movably arranged in the accumulation housing and which defines in the bore of the accumulation housing a variable accumulation chamber for storing therein the fuel under the pressure of a predetermined second level which is higher than the first level, and a pushing means for pushing the piston toward the accumulation chamber to maintain the pressure of the fuel in the accumulation chamber, the piston being moved in accordance with the variation of the amount of the fuel in the accumulation chamber; a fuel injection valve for injecting the fuel in the accumulation chamber into a combustion chamber of the engine, the injection valve being controlled to open and close by an output signal from an external control unit; a pressurizing pump including a pressurizing housing having therein a cylindrical bore, a plunger movably arranged in the bore of the pressurizing housing and which defines in the bore of the pressurizing housing a variable pressurized chamber, and a drive means for reciprocally moving the plunger in the axial direction thereof thus causing the pressurized chamber to decrease and increase in size; a first fuel supply passage for supplying the fuel discharged from the outlet side of the fuel-feed pump into the pressurized chamber when the pressurized chamber is increased in size; a second fuel supply passage for supplying the fuel from the pressurized chamber into the accumulation chamber when the pressurized chamber is decreased in size, the second fuel supply passage being provided with a first check valve for preventing the reverse flow of the fuel from the accumulation chamber into the pressurized chamber; and a work controlling means for controlling the amount of the fuel supplied from the pressurized chamber through the first check valve into the accumulation chamber in accordance with the movement of the piston so as to decrease it when the amount of the fuel in the accumulation chamber is increased and to increase it when the amount of the fuel in the accumulation chamber is decreased.

According to the present invention, the amount of the fuel supplied from the pressurizing pump through a check valve into an accumulator is controlled according to the amount of the fuel in the accumulation chamber of the accumulator. Therefore, it is possible to eliminate useless work of the pressurizing pump and thereby prevent the pump from wasting energy. Also, it is possible to prevent an unfavorable temperature rise of fuel due to a greater pressurization of the fuel than necessary, to prevent noise, vibration, etc. from taking place, and to prevent the fuel injection characteristic from being degraded due to a variation of fuel pressure.

BRIEF DESCRIPTION OF THE DRAWINGS

These and other objects and advantages of the present invention will be better understood from the ensuing description made of the embodiments, by way of example, of the fuel injection system according to the present invention with reference to the drawings, in which.

DESCRIPTION OF THE PREFERRED EMBODIMENTS

Figure 1:
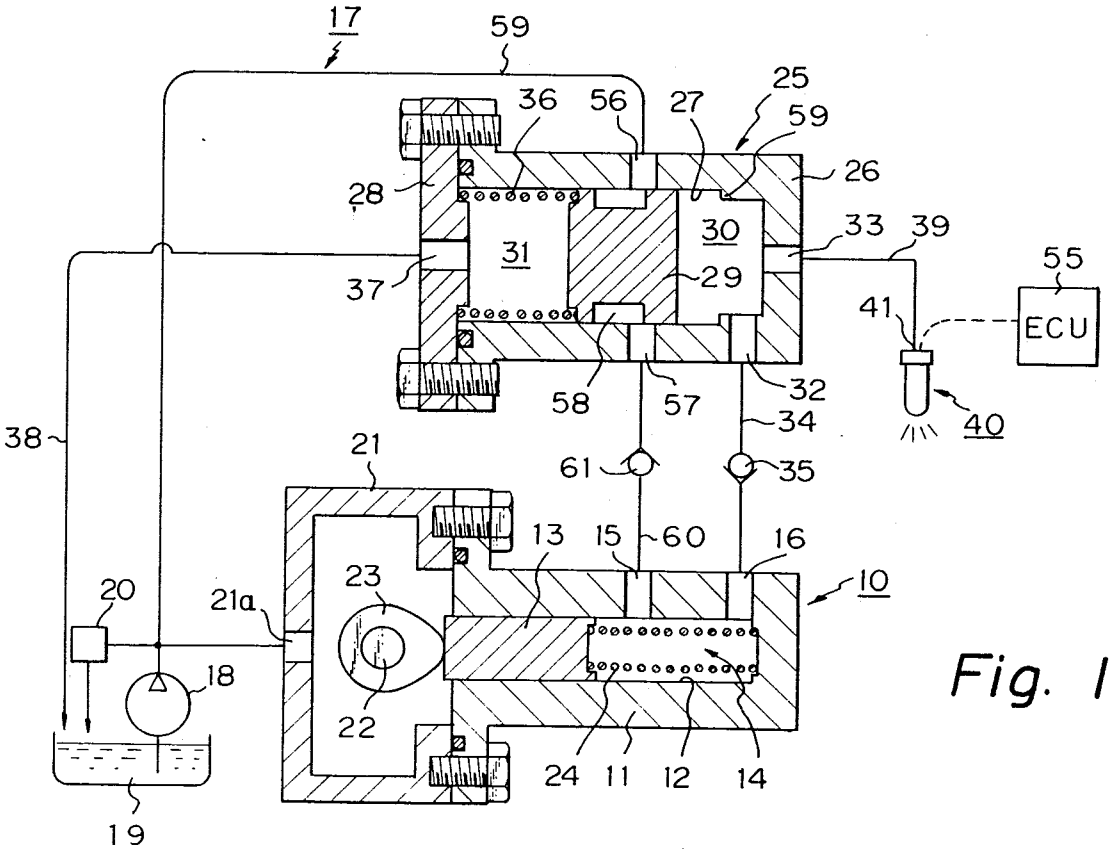
FIG. 1 is a partially sectional, schematic diagram of a first embodiment of the fuel injection apparatus for an internal combustion engine according to the present invention.
Figure 2:
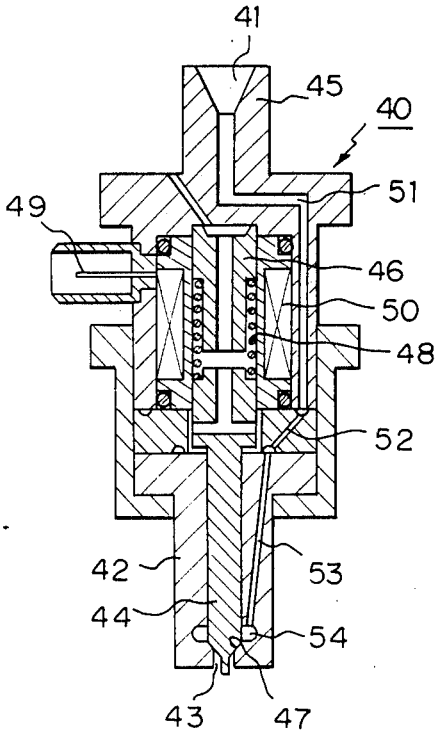
FIG. 2 is a sectional view, enlarged in scale, of the fuel injection valve of the fuel injection apparatus shown in FIG. 1.

FIGS. 1 and 2 show the first embodiment of the present invention. Referring to these figures, the fuel injection apparatus according to the present invention is seen to have a pressurizing pump 10.

The pressurizing pump 10 has a generally cylindrical pump housing 11 having formed therein a cylindrical bore 12 which is opened at one end of the pump housing 11 and in which a plunger 13 is slidably inserted. The plunger 13 and the inner wall of the pump housing 11 define together a pressurized chamber 14.

The pump housing 11 has also formed therein a low pressure fuel intake port 15 and a high pressure fuel delivery port 16. A low pressure fuel supply passage or channel indicated generally by the reference numeral 17 forms at one end thereof the low pressure fuel intake port 15. The other end of the low pressure fuel supply channel 17 is communicated with an outlet side of a fuel-feed pump 18. The fuel-feed pump 18 is connected at the inlet side thereof to a fuel tank 19 in which the fuel is stored under atmospheric pressure. The low pressure fuel supply channel 17 has a regulator 20 connected in the middle thereof. The regulator 20 serves to keep constant, e.g., at 2 atm, the pressure of the low pressure fuel delivered from the fuel-feed pump 18 into the low pressure fuel supply channel 17.

The pump housing 11 of the pressurizing pump 10 has mounted thereon a cam casing 21 in which a rotary cam 23 is disposed, which cam 23 is rotated by a shaft 22. The shaft 22 may be rotated either synchronously with the engine or independently of the engine by using a motor instead. The interior of the cam casing 21 communicates with the cylindrical bore 12 in the pump housing 11. The fuel will be supplied from the feed pump 18 through a port 21*a* into the cam casing 21. The pressure of the fuel is kept constant by means of the regulator 20.

There is provided in the cylindrical bore 12 in the pressurizing pump 10 a spring 24 to force the plunger 13 onto the cam surface of the cam 23. Since the plunger 13 is normally pressed to the cam 23 by the spring 24, it will reciprocate as the cam 23 rotates, thereby compressing the fuel in the pressurized chamber 14. The pressure of the spring 24 is set to a value lower than the fuel supply pressure, namely, the set pressure of the regulator 20, when the plunger 13 is at the top dead point of the cam. For example, the pressure of the spring 24 is so set as to show a reaction of less than 3 kg when the spring is compressed along the maximum stroke in case the pressurized surface area of the plunger 13 is 1 $cm^2$ and the regulator 20 is set for a pressure of 30 $kg/cm^2$.

The fuel injection apparatus is provided with an accumulator 25 having an accumulation housing 26 in which a cylindrical bore 27 is formed. The cylindrical bore 27 opens at one end of the accumulation housing 26, which is provided with an end plate 28 at that end thereof. There is slidably inserted in the cylindrical bore 27 a piston 29 which separates the interior of the accumulation housing 26 into an accumulation chamber 30 and an atmospherically open chamber 31.

The accumulation housing 26 has formed therein a high pressure fuel intake port 32 and a high pressure fuel delivery port 33. The high pressure fuel intake port 32 is communicated with the high pressure fuel delivery port 16 in the pressurizing pump 10 by means of a high pressure fuel channel 34 which has provided in the middle thereof a check valve 35 to prevent the reverse flow of fuel from the accumulation chamber 30 to the pressurized chamber 14.

The atmospherically open chamber 31 has provided therein a spring 36 to force the piston 29 toward the accumulation chamber 30. The fuel in the accumulation chamber 30 is pressurized by the piston 29 forced by the spring 36.

The atmospherically open chamber 31 is opened to the atmosphere through a port 37 formed in the end plate 28. Any fuel spilling through between the piston 29 and inner wall of the accumulation housing 26 into the atmospherically open chamber 31 is returned from the port 37 through a fuel return channel 38 into the fuel tank 19.

The high pressure delivery port 33 in the accumulator 25 is communicated with a fuel inlet 41 in a fuel injection valve 40 through a high pressure fuel channel 39.

Referring now to FIG. 2, the fuel injection valve 40 is seen to have a nozzle body 42 with a nozzle hole 43. A nozzle needle 44 is slidably inserted in the nozzle body 42. The fuel injection valve 40 also has a nozzle holder 45 with the fuel inlet 41 formed therein and in which a core 46 is fixed opposite to the nozzle needle 44. There is provided between the core 46 and nozzle needle 44 a spring 48 which forces the nozzle needle 44 onto a seat surface 47 adjacent to the nozzle hole 43 to close the fuel injection valve 40. Provided around the core 46 is a coil 50 connected to a terminal 49. When the coil 50 is energized through the terminal 49, a magnetic force develops in the coil 50. Under the action of the magnetic force, the needle nozzle 44 is attracted to the core 46 against the force of the spring 48 and finally leaves the seat surface 47.

The fuel inlet 41 in the nozzle holder 45 is communicated with a reserve well 54 adjacent to the seat surface 47 by means of fuel channels 51, 52 and 53. When the nozzle needle 44 leaves the seat surface 47, fuel is injected from the nozzle hole 43.

When the energization of the coil 50 ends, the nozzle needle 44 is forced against to the seat surface 47 under the action of the spring 48, thereby terminating the fuel injection.

The fuel injection valve 40 of each engine cylinder is opened and closed under the control of an electronic control unit (ECU) 55 (FIG. 1). Supplied as input with a crank angle signal, TDC (top dead center) signal, cylinder ID (identification) signal, accelerator pedal angle signal, etc., the ECU 55 will adjust the fuel injection amount and timing for each engine cylinder according to the input signals and send an output signal to the terminal 49 of each fuel injection valve 40.

Reviewing FIG. 1 here, the fuel injection apparatus is seen to also have a means of controlling the work of the pressurizing pump 10 according to the amount of high pressure fuel in the accumulation chamber 30 of the accumulator 25.

In this first embodiment of the fuel injection apparatus according to the present invention, the work controlling means is so arranged as to control the work of the pressurizing pump 10 by controlling the amount of low pressure fuel supplied from the fuel-feed pump 18 through the low pressure fuel supply channel 17 into the pressurized chamber 14 of the pressurizing pump 10.

More particularly, according to the first embodiment, the work controlling means utilizes the piston 29 of the accumulator 25. The piston 29 is displaced according to the amount of high pressure fuel in the accumulation chamber 30 of the accumulator 25, to control the flow rate of the low pressure fuel supplied from the low pressure fuel channel 17 according to the displacement of the piston 29.

The accumulation housing 26 has provided therein ports 56 and 57 which form a part of the low pressure fuel supply channel 17. Also, a circular channel 58 is formed at the outer circumference of the piston 29 to communicate both the ports 56 and 57 with each other. The accumulation housing 26 has formed on the inner wall thereof a stopper 59 to ensure a minimum capacity of the accumulation chamber 30. When the piston 29 is forced by the spring 36 to the stopper 59, the effective opening area between the ports 56 and 57 and the circular channel or recess 58 is maximum. As the piston 29 leaves the stopper 59 and, as shown in FIG. 1, the ports 56 and 57 are displaced in relation to the circular channel 58, the flow rate of fuel supplied into the pressurized chamber 14 of the pressurizing pump 10 will be reduced. When the piston 29 is further moved leftward as viewed on FIG. 1, the ports 56 and 57 will be completely closed by the piston 10, whereby the fuel supply into the pressurized chamber 14 is stopped.

The other one 56 of the ports is connected to the fuel-feed pump 18 through a channel 59 forming a part of the low pressure fuel supply channel 17. The other port 57 is communicated with the low pressure fuel intake port 15 in the pressurizing pump 10 through a channel 60, which also forms a part of the low pressure fuel supply channel 17. The channel 60 has provided in the middle thereof a check valve 61 to prevent any reverse flow of fuel from the pressurized chamber 14 to the lower pressure side.

According to the first embodiment described above, when the amount of fuel in the accumulation chamber 30 of the accumulator 25 is small, the ports 56 and 57 are fully opened. At this time, the fuel flows at the maximum flow rate from the low pressure fuel supply channel 17 into the pressurized chamber 14 of the pressurizing pump 10, whereupon maximum work is attained.

When the fuel consumption through the fuel injection valve 40 is smaller than the delivery from the pressurizing pump 10, as the fuel amount in the accumulation chamber 30 of the accumulator 25 becomes excessive, the piston 29 will be moved leftward as viewed on FIG. 1, and a little later the effective opening area between the ports 56 and 57 and the circular channel 58 will decrease, whereby the amount of fuel supplied into the pressurized chamber 14 of the pressurizing pump 10 is reduced, so that the work of the pressurizing pump 10 will decrease and the flow rate of the high pressure fuel supplied from the pressurizing pump 10 into the accumulation chamber 30 of the accumulator 25 will be reduced.

This action will be more detailed. The plunger 13 normally follows the cam 23, and when the cam 23 pushes at the larger radius portion thereof the plunger 13, the check valve 61 is closed while the check valve 35 is opened, for thereby delivering fuel into the accumulation chamber 30 of the accumulator 25. As the cam 23 turns further and it is in contact at the smaller radius portion thereof with the plunger 13, the check valve 35 is closed while the check vlave 61 is opened, whereby the low pressure fuel is supplied from the fuel-feed pump 18 into the pressurized chamber 14 of the pressurizing pump 10 through the low pressure fuel supply channel 17. However, when the flow rate of the fuel through the circular channel 58 is low, the flow rate of fuel flowing into the pressurized chamber 14 of the pressurizing pump 10 will decrease when the larger radius portion of the cam 23 leaves the end of the plunger 13. At this time, the spring 24 in the pressurizing pump 10 will force the plunger 13 to the cam 23. However, the plunger 13 is now under the fuel supply pressure in the cam casing 21, and also the spring pressure is set to a value lower than the fuel supply pressure. Therefore, the plunger 13 will not follow the larger radius portion of the cam 23, which is turning away from the plunger end and thus leaving the cam 23. Thereafter, the cam 23 will further turn and push at the larger radius portion thereof the end of the plunger 13, and then the fuel in the pressurized chamber 14 will be pressurized. At this time, the amount of the fuel pressurized in the chamber 14 corresponds to the fall of the plunger 13 at the preceding stroke.

When the fuel in the accumulation chamber 30 of the accumulator 25 decreases as the fuel consumption through the fuel injection valve 40 increases, the piston 29 will be moved rightward as viewed in FIG. 1. Thereby, the flow rate of the fuel supplied into the pressurized chamber 14 of the pressurizing pump 10 will increase again and so the flow rate of the fuel supplied from the pressurizing pump 10 to the accumulator 25 will also be increased. In this way, the pressurizing pump 10 will do work corresponding to the fuel amount in the accumulation chamber 30 of the accumulator 25, that is, the fuel consumption through the fuel injection valve 40.

Figure 3:
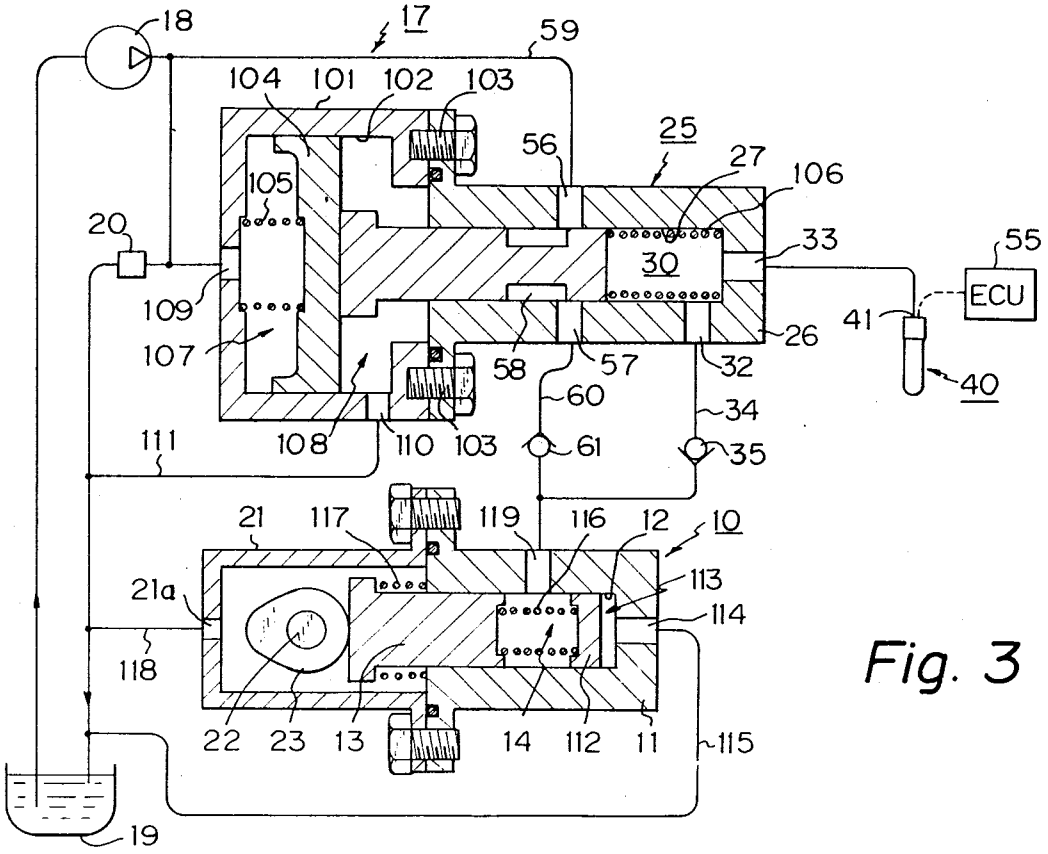
FIG. 3 is a partially sectional, schematic diagram of a second embodiment of the fuel injection apparatus according to the present invention.

FIG. 3 is a schematic diagram of the second embodiment of the fuel injection apparatus according to the present invention. In FIG. 3, elements similar to those in the first embodiment are referred to with the same numerals. The fuel injection valve 40 in this second embodiment is identical to that in the first embodiment, but the accumulator 25 and pressurizing pump 10 are different in construction from those in the first embodiment.

According to the second embodiment, the accumulator 25 also comprises a cylinder housing 101 having formed therein a cylindrical bore 102 which has a larger diameter than the cylindrical bore 27 formed in the accumulation housing 26. The housing 101 is fixed coaxially to one end of the accumulation housing 26 with bolts 103.

The housing 101 has slidably inserted therein a pressurizing piston 104 of a larger diameter than that of the piston 29 and which is forced by springs 105 and 106 to the piston 29. The interior of the housing 101 is separated by the piston 104 into a pressurized chamber 107 and atmospheric chamber 108. The pressurized chamber 107 is always applied through a port 109 with a fuel supply pressure which is controlled by the regulator 20. The atmospheric chamber 108 is opened to the atmosphere through a port 110. Therefore, in this accumulator 25, the piston 104 is forced rightward as viewed in FIG. 3. Any spill fuel entering the atmospheric chamber 108 is returned through a fuel channel 111 into the fuel tank 19.

With this accumulator 25, the high pressure fuel delivered from the pressurizing pump 10 is stored in the accumulation chamber 30. The fuel pressure in the accumulation chamber 30 is a product of the pressure in the pressurized chamber 107 and the ratio in cross-sectional area between the pistons 29 and 104. Assume, for example, that the cross-sectional area of the piston 29 is 1 $cm^2$, that of the piston 104 is 100 $cm^2$, and the pressure in the pressurized chamber 107, namely, the fuel supply pressure, is 3 $kg/cm^2$. The pressure in the accumulation chamber 30 is then 300 $kg/cm^2$.

It should be noted that the forces of the springs 105 and 106 also affect the pressure in the accumulation chamber 30. Assume that the pistons 29 and 104 are located nearly at the position of equilibrium in force between the springs 105 and 106 and that the spring constants of the springs 105 and 106 are 0 and 2 kg/mm, respectively. When the pistons 29 and 104 are moved 10 mm from the position of equilibrium, the force of 4 kg of the springs 105 and 106 will cause the pressure in the accumulation chamber 30 to change only 4 $kg/cm^2$. This change of pressure in the accumulation chamber 30 is ignorably small as compared with the pressure in the accumulation chamber 30, which is 300 $kg/cm^2$.

In the pressurizing pump 10 of the second embodiment, the pump housing 11 has slidably inserted in the cylindrical bore 12 thereof a free piston 112 opposite to the plunger 13. The free piston 112 and plunger 13 define together the pressurized chamber 14. The bottom of the cylindrical bore 12 and the free piston 112 define together a chamber 113 which is always communicaterd with the fuel tank 19 by means of a port 114 and fuel channel 115. Provided between the free piston 112 and plunger 13 is a compression spring 116 which biases the free piston 112 and plunger 13 to move away from each other. Also, a spring 117 is provided between the plunger 13 and pump housing 11 to force the plunger 13 to the cam 23. The spring 116 provided between the free piston 112 and plunger 13 is set for a pressure of less than 1 atmosphere. The interior of the cam casing 21 is communicated with the fuel tank 19 through the port 21*a* and a fuel channel 118.

A port 119 provided as communicating with the pressurized chamber 14 of the pump housing 11 also serves as both a low pressure fuel inlet and high pressure fuel outlet. This port 119 is communicated with the low pressure fuel port 57 of the accumulator 25 by means of the check valve 61, and also with the high pressure fuel intake port 32 of the accumulator 25 by means of the check valve 35.

According to the above-mentioned second embodiment of the fuel injection apparatus, when the fuel consumption through the fuel injection valve 40 is smaller than the fuel supply from the pressurizing pump 10 into the accumulator 25, the high pressure fuel in the accumulation chamber 30 of the accumulator 25 becomes excessive in amount so that the piston 29 will be moved along with the piston 104 leftward as viewed in FIG. 3. Thus, the effective opening area between the ports 56 and 57 forming a part of the low pressure fuel supply channel 17 and the circular channel 58 of the piston 29 is reduced so that the low pressure fuel supplied from the low pressure fuel supply channel 17 into the pressurized chamber 14 of the pressurizing pump 10 will be reduced in flow rate. Accordingly, the work of the pressurizing pump 10 is reduced.

The action of the pressurizing pump 10 will be further detailed. The free piston 112 is normally forced by the spring 116 to the bottom (at the right end) of the cylindrical bore 12. When the cam 23 pushes at the large radius portion thereof the plunger 13, the check valve 61 is closed while the check valve 35 is opened, whereby the low pressure fuel under a constant pressure delivered from the fuel-feed pump 18 is supplied through the low pressure supply channel 17 into the pressurized chamber 14 of the pressurizing pump 10. When the piston 29 is moved leftward as viewed in FIG. 3 and thus the low pressure fuel supply channel is blocked, no low pressure fuel will be supplied into the pressurized chamber 14 as the cam 23 is in contact at the small radius portion thereof with the plunger 13. In this case, the spring 116 is set for a pressure of less than 1 atmosphere, and the free piston 112 is applied with atmospheric pressure through the fuel channel 115 and port 114. Thus, when no low pressure fuel is supplied into the pressurized chamber 14, the free piston 112 is moved leftward as viewed in FIG. 3 as attracted toward the plunger 13. Also, when the cam 23 pushes at the large radius portion thereof the end of the plunger 13, the free piston 112 is moved rightward as viewed in FIG. 3 as pushed by the plunger 13. Therefore, no capacity change occurs in the pressurized chamber 14, so that the pressurizing pump 10 will not do any work.

When the displacement of the piston 29 in the accumulator 25 is small and consequently the low pressure fuel is supplied at a reduced flow rate into the pressurized chamber 14 of the pressurizing pump 10, the free piston 112 is moved leftward as viewed in FIG. 3 as attracted toward the plunger 13, which is in contact at the end thereof with the small radius portion of the cam 23. However, a certain amount of fuel will enter the pressurized chamber 14, and so the displacement of the free piston 112 is small as compared with that when no fuel is supplied into the pressurized chamber 14. Therefore, when the cam 23 pushes at the large radius portion thereof the end of the plunger 13 again, the free piston 112 is diplaced rightward as viewed in FIG. 3 and soon abuts the bottom (right end face as viewed on FIG. 3) of the cylindrical bore 12. As the plunger 13 is displaced continuously rightward, the fuel in the pressurized chamber 14 is pressurized and supplied into the accumulation chamber 30 of the accumulator 25.

As explained and illustrated, also in the second embodiment, the flow rate of the fuel delivered toward the accumulation chamber 30 of the accumulator 25 from the pressurizing pump 10 is equal to the rate of fuel consumption through the fuel injection valve 40, and so no extra load will be applied to the pressurizing pump 10.

Figure 4:
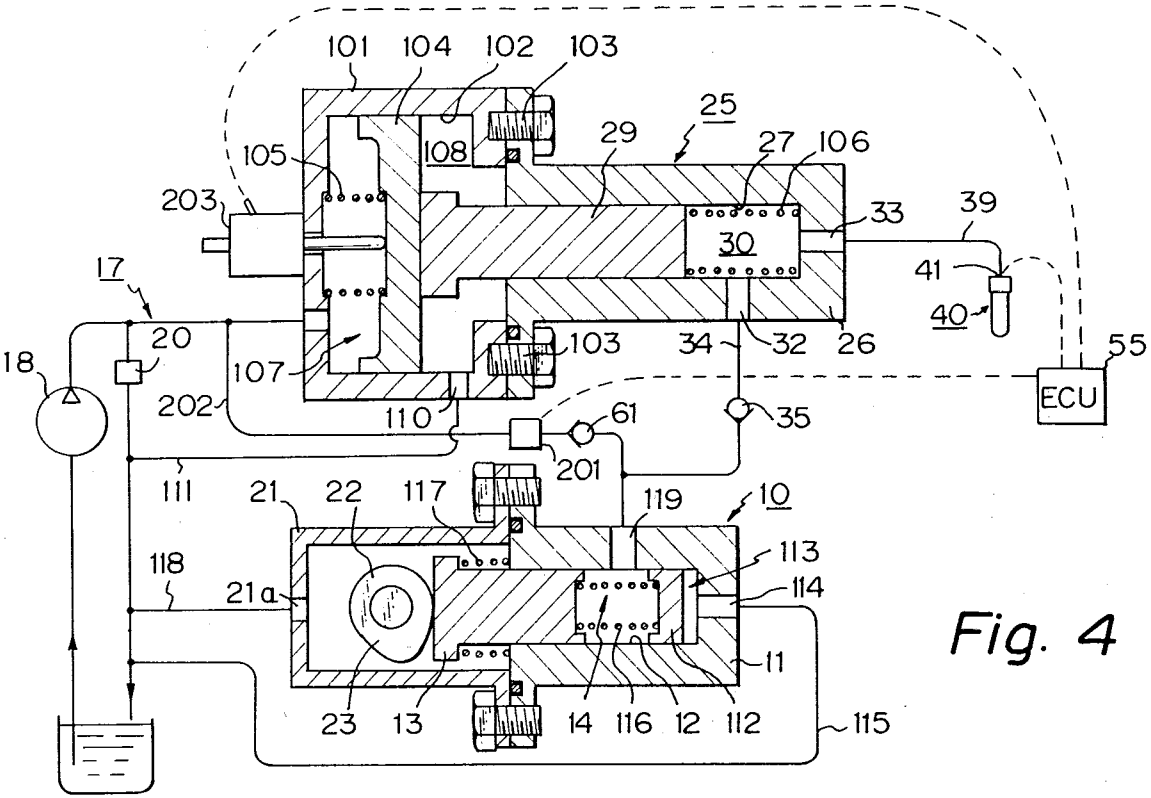
FIG. 4 is a partially sectional, schematic diagram of a third embodiment of the fuel injection apparatus according to the present invention.

FIG. 4 shows the third embodiment of the fuel injection apparatus according to the present invention. In FIG. 4, elements similar to those of the first and second embodiments illustrated and explained in the foregoing are referred to with the same numerals. The third embodiment has a similar construction to that of the second embodiment, but it is different from the second embodiment in that the displacement of the piston 29, which is moved depending on the change in amount of high pressure fuel in the accumulation chamber 30 of the accumulator 25, is detected to electrically control the flow rate of the low pressure fuel supplied into the pressurized chamber 14 of the pressurizing pump 10 from the low pressure fuel supply channel 17.

According to the third embodiment, the low pressure fuel supply channel 17 has a fuel channel 202 which runs from the feed pump 18 through a solenoid valve 201 and check valve 61 to a port 119 of the pressurizing pump 10. The third embodiment has no such ports as 56 and 57 in the accumulator 25 and no such circular recess or channel as 58 of the piston 29 in the second embodiment. Also, the accumulator 25 is provided with a detector, e.g., a potentiometer 203, to detect the displacement of the piston 29 by means of the piston 104. The potentiometer delivers a detection signal to the ECU 55, and the solenoid valve 201 is opened and closed under the control of a signal from the ECU 55. As the high pressure fuel in the accumulation chamber 30 of the accumulator 25 increases in amount, the pistons 29 and 104 are moved leftward as viewed in FIG. 4. Along with this displacement of the pistons, the output of the potentiometer 203 increases. Soon after, when the output from the potentiometer 203 exceeds a preset value, the solenoid valve 201 is closed under the control of a signal from the ECU 55, whereby the supply of low pressure fuel from the low pressure fuel supply channel 17 into the pressurized chamber 14 of the pressurizing pump 10 is decreased or stopped. On the other hand, when the high pressure fuel in the accumulation chamber 30 decreases in amount, the pistons 29 and 104 are displaced rightward as viewed in FIG. 4. Accordingly, the output of the potentiometer 203 decreases. Finally, when the output of the potentiometer 203 decreased below the preset value, the solenoid valve 201 is opened, whereby the low pressure fuel delivered from the feed pump 18 and kept at a pressure set by the regulator 20 is supplied through the low pressure fuel supply channel 17 into the pressurized chamber 14 of the pressurizing pump 10. Other actions are the same as those in the second embodiment. Therefore, the pressurizing pump 10 will do work corresponding to the fuel consumption through the fuel injection valve 40 also in the third embodiment.

Figure 5:
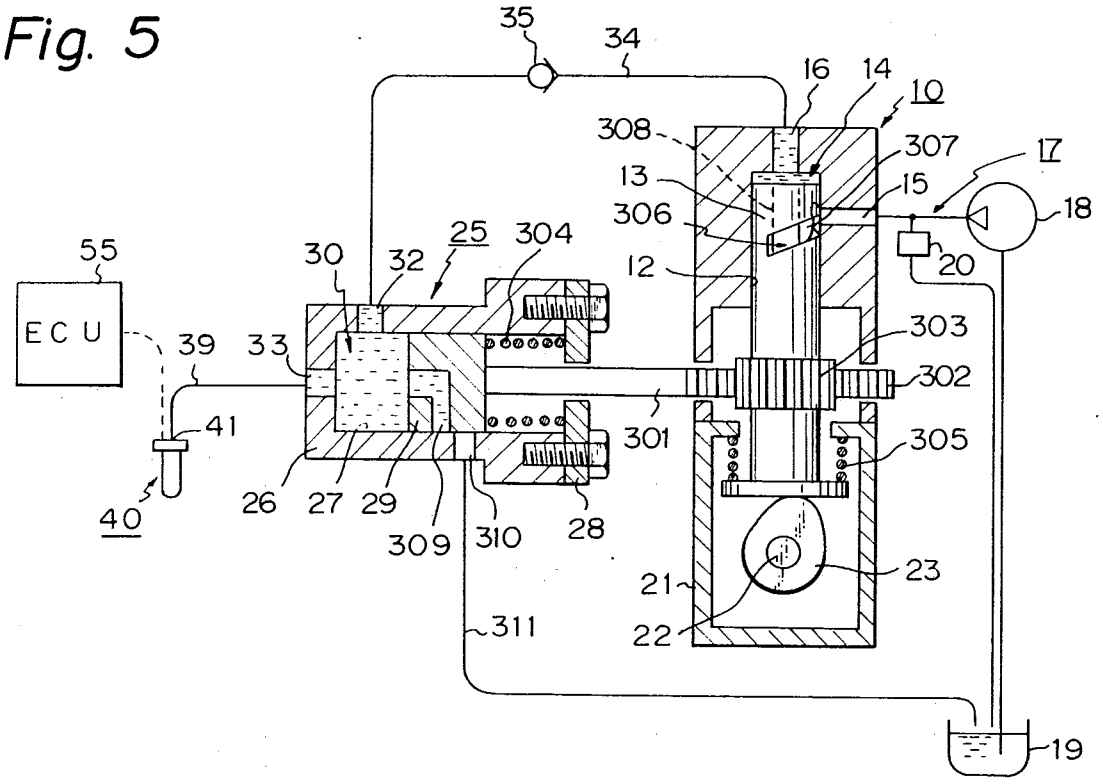
FIG. 5 is a partially sectional, schematic diagram of a fourth embodiment of the fuel injection apparatus according to the present invention.

FIG. 5 shows the fourth embodiment of the fuel injection apparatus according to the present invention. In FIG. 5, elements similar to those in the first embodiment are referred to with the same numerals.

In the first to third embodiments, the flow rate at which the low pressure fuel is supplied from the low pressure fuel supply channel 17 into the pressurized chamber 14 of the pressurizing pump 10 is adjusted. On the contrary, according to the fourth embodiment, the flow rate at which the low pressure fuel is supplied into the pressurized chamber 14 of the pressurizing pump 10 is fixed while the pressurization by the pressurizing pump 10 itself is controlled according to the fuel consumption through the fuel injection valve 40, that is, the fuel amount in the accumulation chamber 30 of the accumulator 25.

In this fourth embodiment, the piston 29 slidably inserted in the accumulation housing 26 of the accumulator 25 has fixed thereon a rod 301 with a rack 302 which is in mesh with a pinion gear 303 provided on the plunger 13 of the pressurizing pump 10. The pinion gear 303 is supported rotatably and axially immovably to the pump housing 11. The plunger 13 is coupled relatively unrotatably and axially movably to the pinion gear 303 by a means such as a spline or key.

The piston 29 is forced by a spring 304 in a direction of pressing the accumulation chamber 30. The plunger 13 is forced by another spring 305 in a direction of being pressed to the cam 23.

The high pressure fuel in the pressurized chamber 14 of the pressurizing pump 10 is supplied from the high pressure fuel delivery port 16 formed in the pump housing 11 into the accumulation chamber 30 through the fuel channel 34 and high pressure fuel intake port 32 of the accumulator 25. The fuel channel 34 has provided in the middle thereof a check valve 35 to prevent any reverse flow of fuel. The high pressure fuel delivery port 16 is opened at the bottom end of the cylindrical bore 12.

The pump housing 11 of the pressurizing pump 10 has formed therein the low pressure fuel intake port 15 which is connected with the fuel-feed pump 18 through the low pressure fuel supply channel 17. The fuel pressure in the low pressure fuel supply channel 17 is kept at a predetermined level by the regulator 20. The low pressure fuel intake port 15 is opened at the inner circumferential surface of the cylindrical bore 12.

The plunger 13 has formed therein a by-pass passage 306 to provide communication between the low pressure fuel intake port 15 and pressurized chamber 14. The by-pass passage 306 is provided with an outer circumferential recess 307, formed along the outer circumference of the plunger 13 and obliquely with respect to the axis of the plunger 13, and a port 308 to provide communications between the outer circumferential recess 307 and the pressurized chamber 14.

According to the fourth embodiment, when the cam 23 reaches the top dead point, the top end face (as viewed in FIG. 5) of the plunger 13 falls down to under the low pressure fuel intake port 15, whereby the low pressure fuel delivered from the fuel-feed pump 18 is supplied through the low pressure fuel supply channel 17 and low pressure fuel intake port 15 into the pressurized chamber 14. As the cam 23 further rotates and consequently the plunger 12 rises, the low pressure fuel intake port 15 is blocked by the plunger 13, so that the chamber 14 starts being pressurized. When the plunger further rises until the outer circumferential recess 307 in the plunger 13 communicates with the low pressure fuel intake port 15, then the pressure in the pressurized chamber 14 is released to the low pressure fuel supply channel 17 through the channel 308 and outer circumferential recess 307, whereby the chamber 14 stops being pressurized. Since the outer circumferential recess 307 is formed obliquely in the outer circumferential face of the plunger 13, the stroke from the start until the end of the pressurization of the chamber 14 by the plunger 13 varies along with the rotational displacement of the plunger 13, with the result that the extent of pressurization, that is, the delivery from the pressurizing pump 10, will change.

The plunger 13 is rotationally displaced according to the change in amount of the high pressure fuel in the accumulation chamber 30 of the accumulator 25. That is to say, as the amount of high pressure fuel in the accumulation chamber 30 increases and consequently the piston 29 is moved rightward as viewed in FIG. 5, the rack 302 causes the pinion gear 303 to be rotated along with the plunger 13 counterclockwise as viewed from below in FIG. 5, whereby the pressure on the fuel decreases. Also, when the high pressure fuel in the accumulation chamber 30 decreases in amount, the piston 29 is moved leftward as viewed in FIG. 5, the pinion gear 303 is rotated along with the plunger 13 clockwise as viewed from below in FIG. 5, and thus the pressure on the fuel increases. As the above operation is repeatedly done, the piston 29 will stay in a substantially stable position and the pressure in the accumulation chamber 30 is kept at a constant pressure determined by the spring 304. Since the pressurizing pump 10 does not pressurize any extra fuel, it will not be applied with any extra load. In this way, the pressurizing pump 10 will not do any extra work.

According to the fourth embodiment, the piston 29 has formed therein a channel 309 which communicates with the accumulation chamber 30, and the accumulation housing 26 has formed therein a port 310 which will be communicated with the channel 309 when the piston 29 is moved a distance more than a predetermined one rightward as viewed in FIG. 5. The port 310 is communicated with the fuel tank 19 by means of a fuel channel 311. Since the channel 309, port 310, and fuel channel 311 act together as a regulator to keep more stable the pressure in the accumulation chamber 30, it is possible to effectively prevent the high pressure fuel from being supplied as pulsated.

Embodiments of the fuel injection apparatus for an internal combustion engine according to the present invention have been illustrated and explained in the foregoing, however the present invention is not limited to those embodiments. It is apparent to those skilled in the art that the present invention can be embodied with various variations or modifications applied to its elements without departing from the claims set forth later.

We claim:

1. A fuel injection apparatus for an internal combustion engine, comprising:

an accumulator for storing therein pressurized fuel and continuously maintaining a pressure thereof at a predetermined fixed high level;

a fuel injection valve continuously connected to said accumulator for injecting the pressurized fuel in the accumulator into a combustion chamber of the engine, said injection valve being controlled to open and close by output signals from an external control unit;

a pressurized pump for pressurizing fuel delivered from a fuel-feed pump and for supplying it into said accumulator through a check valve; and a work controlled means for controlling the amount of fuel supplied from said pressurizing pump through said check valve into said accumulator in accordance with variations of amount of fuel in said accumulator so as to decrease the amount of the fuel supplied from said pressurizing pump through said check valve into said accumulator when the amount of fuel in said accumulator is increased and to increase it when the amount of fuel in said accumulator is decreased.

2. A fuel injection apparatus for an internal combustion engine, comprising:

a fuel-feed pump for continuously discharging through an outlet side thereof fuel under pressure of a predetermined first level which is higher than atmospheric pressure, said fuel-feed pump being connected at the inlet side thereof to a fuel tank which stores the fuel under atmospheric pressure;

an accumulator including an accumulation housing having therein a cylindrical bore, a piston movably arranged in said accumulation housing and which defines in said bore of said accumulation housing a variable accumulation chamber for storing therein fuel under pressure of a predetermined second level which is higher than said first level, and a pushing means for pushing said piston toward said accumulation chamber to maintain the pressure of the fuel in said accumulation chamber, said piston being moved in accordance with variations of amount of fuel in said accumulation chamber;

a fuel injection valve for injecting fuel in said accumulation chamber into a combustion chamber of the engine, said injection valve being controlled to open and close by output signals from an external control unit;

a pressurizing pump including a pump housing having therein a cylindrical bore, a plunger movably arranged in said bore of said pump housing and which defines in said bore of said pump housing a variable pressurized chamber, and a drive means for reciprocally moving said plunger in the axial direction thereof thus causing said pressurized chamber to decrease and increase in size;

a first fuel supply passage for supplying fuel discharged from said outlet side of said fuel-feed pump into said pressurized chamber when said pressurized chamber is increased in size;

a second fuel supply passage for supplying fuel from said pressurized chamber into said accumulation chamber when said pressurized chamber is decreased in size, said second fuel supply passage being provided with a first check valve for preventing reverse flow of the fuel from said accumulation chamber into said pressurized chamber; and a work controlling means for controlling the amount of fuel supplied from said pressurized chamber through said first check valve into said accumulation chamber in accordance with movement of said piston so as to decrease it when the amount of fuel in said accumulation chamber is increased and to increase it when the amount of fuel in said accumulation chamber is decreased.

3. An apparatus according to claim 2, wherein said first fuel supply passage is always connected to said pressurized chamber through a second check valve for preventing reverse flow of fuel from said pressurized chamber to said outlet side of said fuel-feed pump, and wherein said work controlling means includes a flow regulating means which is adapted to control the amount of fuel to be supplied from said outlet side of said fuel-feed pump through said first fuel supply passage into said pressurized chamber in accordance with movement of said piston so as to decrease the amount of fuel supplied into said pressurized chamber and thereby to decrease the amount of fuel supplied into said accumulation chamber when the amount of the fuel in said accumulation chamber is increased.

4. An apparatus according to claim 3, wherein said first fuel supply passage includes a pair of separated first and second stationary ports which are open to said bore of said accumulation housing, said first stationary port being connected to said outlet side of said fuel-feed pump while said second stationary port being connected to said pressurized chamber, and wherein said flow regulating means includes a movable passage arranged in said piston and adapted to connect with said first and second stationary ports, said movable passage having an opening region which is open to said first and second stationary ports and is varied in accordance with the movement of said piston so that the amount of fuel supplied through said opening region into said pressurized chamber is decreased when the amount of fuel in said accumulation chamber is increased.

5. An apparatus according to claim 3, wherein said flow regulating means includes a solenoid valve arranged in said first fuel supply passage and which is controlled to open and close said first fuel supply passage by output signals from a detector for detecting the displacement of said piston so as to decrease the amount of the fuel supplied from said outlet side of said fuel-feed pump into said pressurized chamber when the amount of the fuel in said accumulation chamber is increased and to increase it when the amount of the fuel in said accumulation chamber is decreased.

6. An apparatus according to claim 2, wherein said first fuel supply passage is so arranged that it is directly connected to said pressurized chamber when said pressurized chamber is increased to a maximum volume and wherein said work controlling means includes:

a by-pass port arranged in said plunger to spill the fuel from said pressurized chamber into said first fuel supply passage when said pressurized passage is decreased, said by-pass port having a first end portion which is always open to said pressurized chamber while having a second end portion which is formed on the outer periphery of said plunger and extends helically along the outer periphery of said plunger to connect with said first fuel supply port, the timing of connection of said second end portion of said by-pass port with said first fuel supply passage being changed in accordance with the rotational movement of said plunger; and a rotating means connecting said piston of said accumulator with said plunger to rotate said plunger in accordance with the movement of said piston so that the amount of said fuel spilled from said pressurized chamber through said by-pass port into said first fuel supply passage is increased when the amount of the fuel in said accumulation chamber is increased.

7. An apparatus according to claim 6, wherein said rotating means includes a rack connected to said piston to move together therewith, and a pinion gear connected to said plunger to rotate together therewith and which is in mesh with said rack.

8. An apparatus according to claim 2, wherein said pushing means of said accumulator is a spring which pushes said piston toward said accumulation chamber.

9. An apparatus according to claim 2, wherein said pushing means of said accumulator includes:

a cylinder housing attached on said accumulation housing and having therein a cylindrical bore having a diameter which is larger than that of said bore of said accumulation chamber; and a pushing piston connected to said piston in said bore of said accumulation chamber and movably arranged in said bore of said cylinder housing to define in said bore of said cylinder housing a variable fuel chamber in which the fuel discharged from said outlet side of said fuel-feed pump is always supplied, the pressure within said fuel chamber always acting on said pushing piston to push it toward said piston in said bore of said accumulation chamber.

10. An apparatus according to claim 2, 3, or 6, wherein said drive means of said pressurizing pump includes:

a rotary cam haivng a cam surface which includes a large radius portion and a small radius portion which is smoothly connected to said large radius portion;

a pushing spring for pushing said plunger onto said cam surface of said rotary cam; and a cam shaft arranged to rotate said rotary cam thus causing said plunger to move reciprocally in the axial direction thereof.

11. An apparatus according to claim 10, wherein said drive means of said pressurizing pump further includes a cam casing in which fuel discharged from said outlet side of said fuel-feed pump is introduced, the pressure within said cam casing always acting on said plunger and balancing with the pressure in said pressurized chamber when said pressurized chamber is increased in size.

12. An apparatus according to claim 3, wherein said pressurizing pump further includes a free piston movably arranged in said bore of said pump housing and facing with said plunger to define said pressurized chamber in said bore of said pump housing, a compression spring arranged between said plunger and said free piston to push said free piston away from said plunger, said free piston defining in said bore of said pump housing a chamber in which atmospheric pressure is introduced.

* * * * *